US009002241B2

(12) United States Patent
Yamanaka

(10) Patent No.: US 9,002,241 B2
(45) Date of Patent: Apr. 7, 2015

(54) IMAGE FORMING APPARATUS AND TONER CASE

(71) Applicant: KYOCERA Document Solutions Inc., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/085,434

(22) Filed: Nov. 20, 2013

(65) Prior Publication Data

US 2014/0140737 A1 May 22, 2014

(30) Foreign Application Priority Data

Nov. 22, 2012 (JP) ..... 2012-256288

(51) Int. Cl.
*G03G 15/08* (2006.01)
*G03G 21/16* (2006.01)

(52) U.S. Cl.
CPC ..... *G03G 21/1676* (2013.01); *G03G 15/0886* (2013.01)

(58) Field of Classification Search
USPC ..... 399/260, 258, 107, 119
See application file for complete search history.

(56) References Cited

U.S. PATENT DOCUMENTS 5,294,963 A * 3/1994 Nakano et al. ..... 399/106
2012/0114387 A1* 5/2012 Horii et al. ..... 399/258
2013/0243491 A1* 9/2013 Nodera et al. ..... 399/260

FOREIGN PATENT DOCUMENTS

JP H01-219866 A 9/1989
JP 2008-112198 A 5/2008

OTHER PUBLICATIONS

An Office Action; "Notice of Reasons for Rejection," issued by the Japanese Patent Office on Dec. 16, 2014, which corresponds to Japanese Patent Application No. 2012-256288 and is related to U.S. Appl. No. 14/085,434.

* cited by examiner

*Primary Examiner* — Billy Lactaoen
(74) *Attorney, Agent, or Firm* — Studebaker & Brackett PC

(57) ABSTRACT

An image forming apparatus includes an attachment member and a toner case. The toner case has a discharge port openable and closable by a shutter mechanism. The shutter mechanism has a first shutter member and a second shutter member. The first shutter member closes the discharge port in a condition in which the toner case is detached from the attachment member, and opens the discharge port in a condition in which the toner case is attached to the attachment member. The second shutter member covers the back side edge portion of the communication port with which the discharge port is communicated in a condition in which the toner case is detached from the attachment member, and exposes the back side edge portion of the communication port in a condition in which the toner case is attached to the attachment member.

16 Claims, 15 Drawing Sheets

IMAGE FORMING APPARATUS AND TONER CASE

INCORPORATION BY REFERENCE

This application is based on and claims the benefit of priority from Japanese Patent application No. 2012-256288 filed on Nov. 22, 2012, the entire contents of which are incorporated herein by reference.

BACKGROUND

The present disclosure relates to an image forming apparatus and a toner case provided at the image forming apparatus.

In an electrographic image forming apparatus, a toner (developer) is supplied on an electrostatic latent image formed on a photoconductor drum or the like from a development device to carry out a development operation. The toner used for the development operation is supplied to the development device from a toner case. The above-mentioned toner case is detachably provided at an attachment member (for example, a main body of the apparatus) provided at the image forming apparatus, for example, in order to be able to be changed after consuming the toner inside the toner case fully.

The above-mentioned toner case usually includes a case main body having a discharge port configured to discharge the toner and a shutter mechanism configured to open and close the above-mentioned discharge port. For example, there exists a shutter mechanism provided with a supporting member arranged outside the case main body and a shutter member supported by the supporting member. For example, a communication port communicated with the discharge port of the case main body is provided at the above-mentioned supporting member and the communication port can be opened or closed with the above-mentioned shutter member.

However, if the above-mentioned configuration is applied, the toner discharged from the discharge port of the case main body would adhere to the communication port of the supporting member. And, when the toner case is changed, the adhered toner to the communication port of the supporting member may contaminate a user's body or surrounding floor.

SUMMARY

In accordance with an embodiment of the present disclosure, an image forming apparatus includes an attachment member and a toner case. The toner case is attachable and detachable to/from the attachment member along an attachment direction. The toner case has a case main body and a shutter mechanism. The case main body has a discharge port configured to discharge a toner. The shutter mechanism is configured to open and close the discharge port. The shutter mechanism has a supporting member, a first shutter member and a second shutter member. The supporting member is arranged outside the case main body and has a communication port communicating with the discharge port. The first shutter member is positioned at a closing position configured to close the discharge port and the communication port in a condition in which the toner case is detached from the attachment member, and at an opening position configured to open the discharge port and the communication port in a condition in which the toner case is attached to the attachment member. The second shutter member is positioned at a covering position configured to cover the back side edge portion of the communication port in the attachment direction from the outside in a condition in which the toner case is detached from the attachment member, and at an exposing position configured to expose the back side edge portion of the communication port in the attachment direction in a condition in which the toner case is attached to the attachment member.

In accordance with an embodiment of the present disclosure, a toner case is provided at an image forming apparatus with an attachment member and is attachable and detachable to/from the attachment member along an attachment direction. The toner case includes a case main body and a shutter mechanism. The case main body has a discharge port configured to discharge a toner. The shutter mechanism is configured to open and close the discharge port. The shutter mechanism has a supporting member, a first shutter member and a second shutter member. The supporting member is arranged outside the case main body and has a communication port communicating with the discharge port. The first shutter member is positioned at a closing position configured to close the discharge port and the communication port in a condition in which the toner case is detached from the attachment member, and at an opening position configured to open the discharge port and the communication port in a condition in which the toner case is attached to the attachment member. The second shutter member is positioned at a covering position configured to cover the back side edge portion of the communication port in the attachment direction from the outside in a condition in which the toner case is detached from the attachment member, and at an exposing position configured to expose the back side edge portion of the communication port in the attachment direction in a condition in which the toner case is attached to the attachment member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
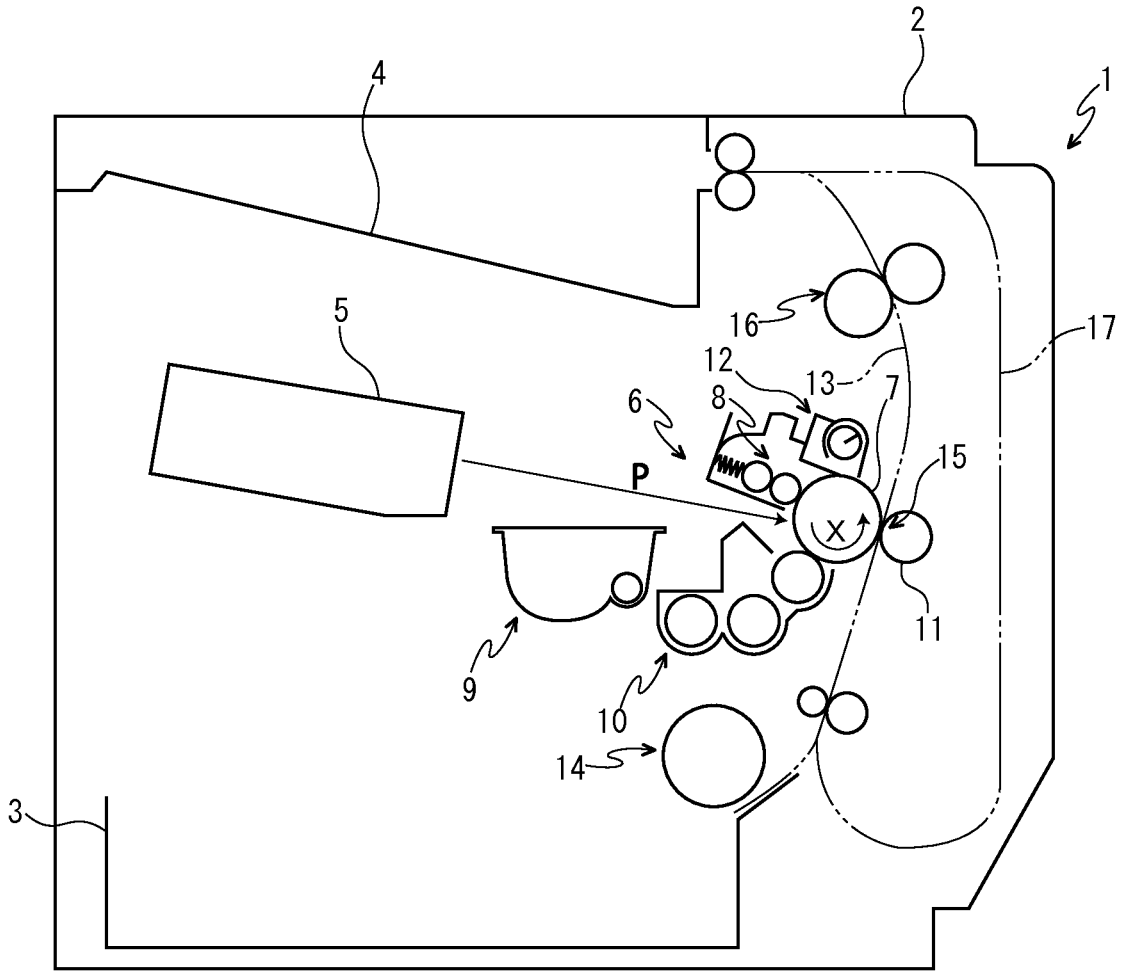
FIG. 1 is a schematic diagram schematically showing a printer according to an embodiment of the present disclosure.

With reference to FIG. 1, the entire structure of a printer 1 (an image forming apparatus) will be described. FIG. 1 is a schematic diagram schematically showing the printer according to an embodiment of the present disclosure.

The printer 1 includes a box-formed printer main body 2. In a lower part of the printer main body 2, a sheet feeding cartridge 3 storing sheets (not shown) is provided and, in an upper end of the printer main body 2, a sheet ejecting tray 4 is provided.

In a left part of the printer main body 2, an exposure device 5 consisting of a laser scanning unit (LSU) is arranged. In the right part of the printer main body 2, an image forming unit 6 are provided. In the image forming unit 6, a photosensitive drum 7 is rotatably provided. Around the photosensitive drum 7, a charger 8, a developing device 10 connected to a toner cartridge 9 (toner case), a transferring roller 11 and a cleaning device 12 are arranged along the rotational direction of the photosensitive drum 7 (refer to arrow X in FIG. 1). The developing device 10 is filled with the toner. The toner includes one component developer composing of the toner and two components developer composing of the toner and a carrier.

On the right side of the printer main body 2, a sheet conveying path 13 is provided from the bottom to the top. At an upper stream end of the conveying path 13, a sheet feeder 14 is provided. At an intermediate stream part of the conveying path 13, a transferring unit 15 formed by the photosensitive drum 7 and the transferring roller 11 is provided. At a lower stream part of the conveying path 13, a fixing device 16 is provided. At the right side of the conveying path 13, an inversion path 17 for both sides printing is provided.

Next, the operation of forming an image by the printer 1 having such a configuration will be described.

When the power is supplied to the color printer 1, various parameters are initialized and initial determination, such as temperature determination of the fixing device 16, is carried out. Subsequently, when image data is inputted and a printing start is directed from a computer or the like connected with the printer 1, the image forming operation is carried out as follows.

First, the surface of the photosensitive drum 7 is electrically charged by the charger 8. Then, the surface of the photosensitive drum 7 is exposed corresponding to the image data with a laser (refer to arrow P) from the exposure device 5, thereby forming an electrostatic latent image on the surface of the photosensitive drum 7. The electrostatic latent image is developed to a toner image with the toner supplied from the toner cartridge 9 by the development device 10.

On the other hand, a sheet fed from the sheet feeding cartridge 3 by the sheet feeder 14 is conveyed to the transferring unit 15 in a suitable timing for the above-mentioned image forming operation. Then, in the transferring unit 15, the toner image is transferred onto the sheet. The sheet with the transferred toner image is conveyed to a lower stream side on the conveying path 13 to enter the fixing device 16, and then, the toner image is fixed on the sheet in the fixing device 16. The sheet with the fixed toner image is ejected from the downstream end of the conveying path 13 onto the sheet ejecting tray 4. The toner remained on the photosensitive drum 7 is collected by the cleaning device 12.

Next, the toner cartridge 9 will be described in detail. Arrows Fr, Rr, L and R put on each figure indicate the front side, the back side, the left side and the right side of the toner cartridge 9, respectively.

Figure 2:
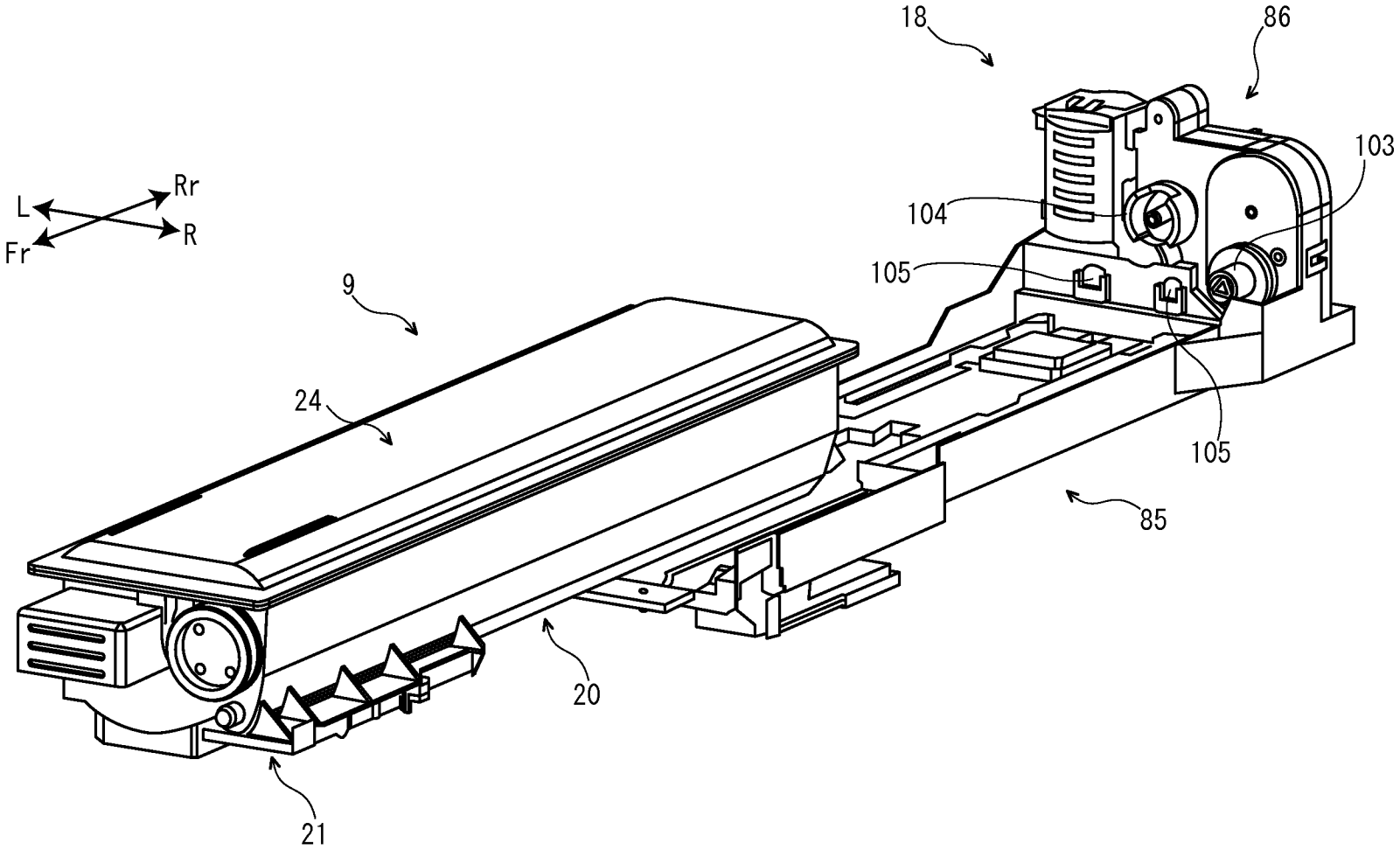
FIG. 2 is a perspective view showing a condition under attaching the toner cartridge to the attachment member in the printer according to the embodiment of the present disclosure.
Figure 3:
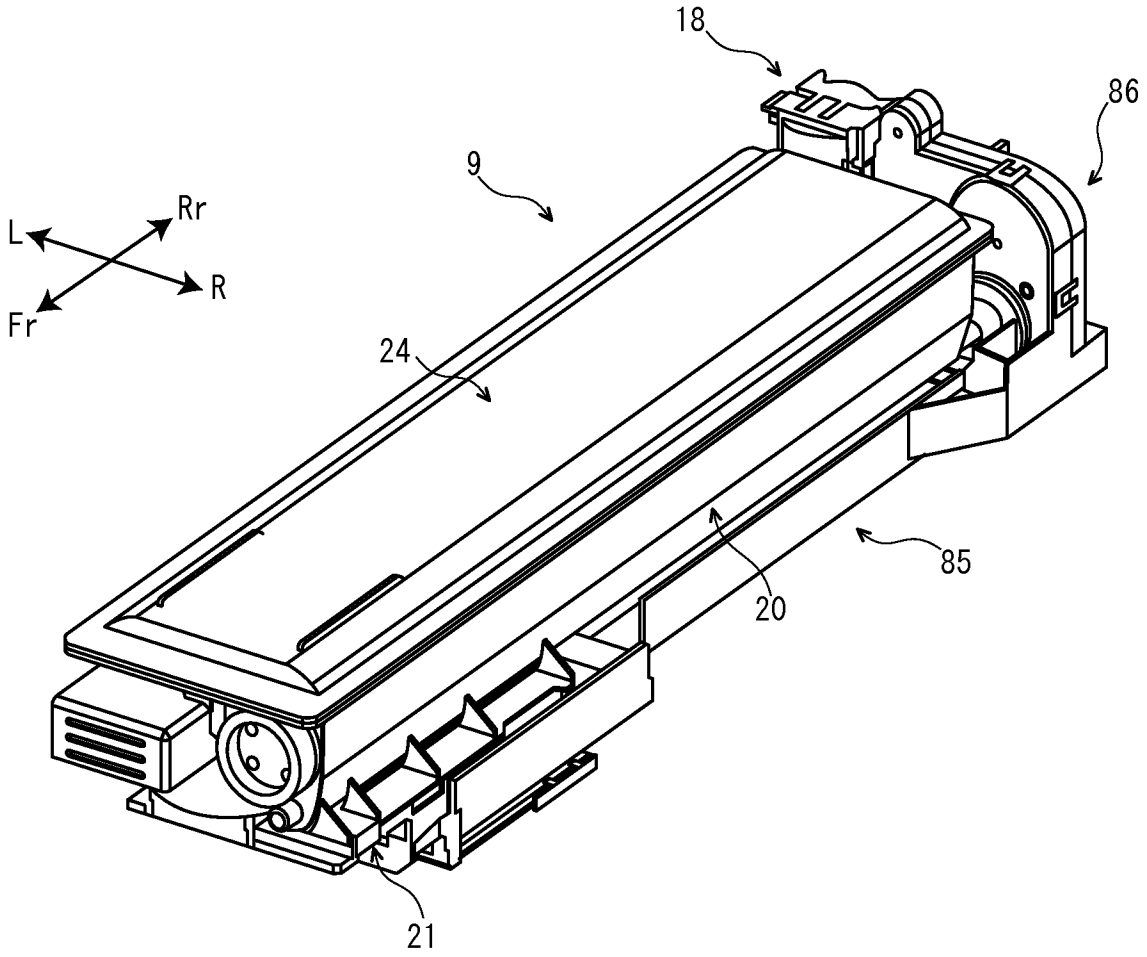
FIG. 3 is a top perspective view showing a condition in which the toner cartridge is attached to the attachment member in the printer according to the embodiment of the present disclosure.

As shown in FIGS. 2 and 3, the toner cartridge 9 is configured to be attached and detached to/from an attachment member 18 (described later in detail) along the forward and backward directions. That is, in the embodiment, the forward and backward directions indicate a direction in which the toner cartridge 9 is attached to the attachment member 18. And, in the embodiment, the front side indicates the near side in the direction in which the toner cartridge 9 is attached to the attachment member 18 and the back side indicates the far side in the direction in which the toner cartridge 9 is attached to the attachment member 18. Hereinafter, an "attachment direction" indicates an attachment direction in which the toner cartridge 9 is attached to the attachment member 18.

Figure 4:
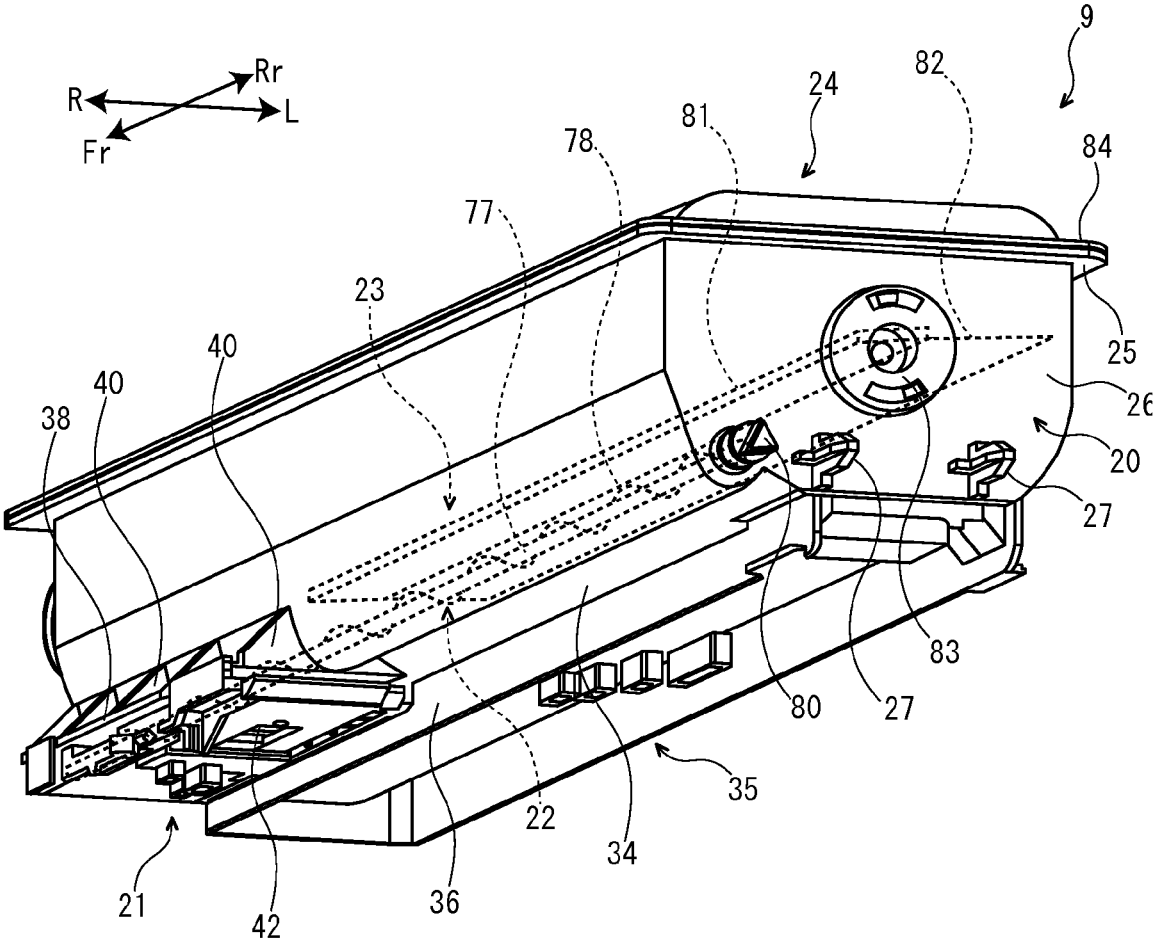
FIG. 4 is a back and bottom perspective view showing the toner cartridge of the printer according to the embodiment of the present disclosure.

As shown in FIG. 4, the toner cartridge 9 has a box-shaped case main body 20 with the upper surface opened, a shutter mechanism 21 arranged at the right and lower of the front portion of the case main body 20, a conveying screw 22 stored in the right and lower space of the case main body 20, an agitating paddle 23 arranged in substantially a center space of the case main body 20 and a covering body 24 configured to close the upper surface of the case main body 20. Hereinafter, the components will be described in the above-mentioned order.

Firstly, the case main body 20 will be described. The case main body 20 has a shape elongated in the forward and backward directions. At the circumference of the upper end of the case main body 20, a main body side flange 25 is provided. At the lower end portion of the back end wall 26 of the case main body 20, a pair of left and right attachment projections 27 are provided.

Figure 5:
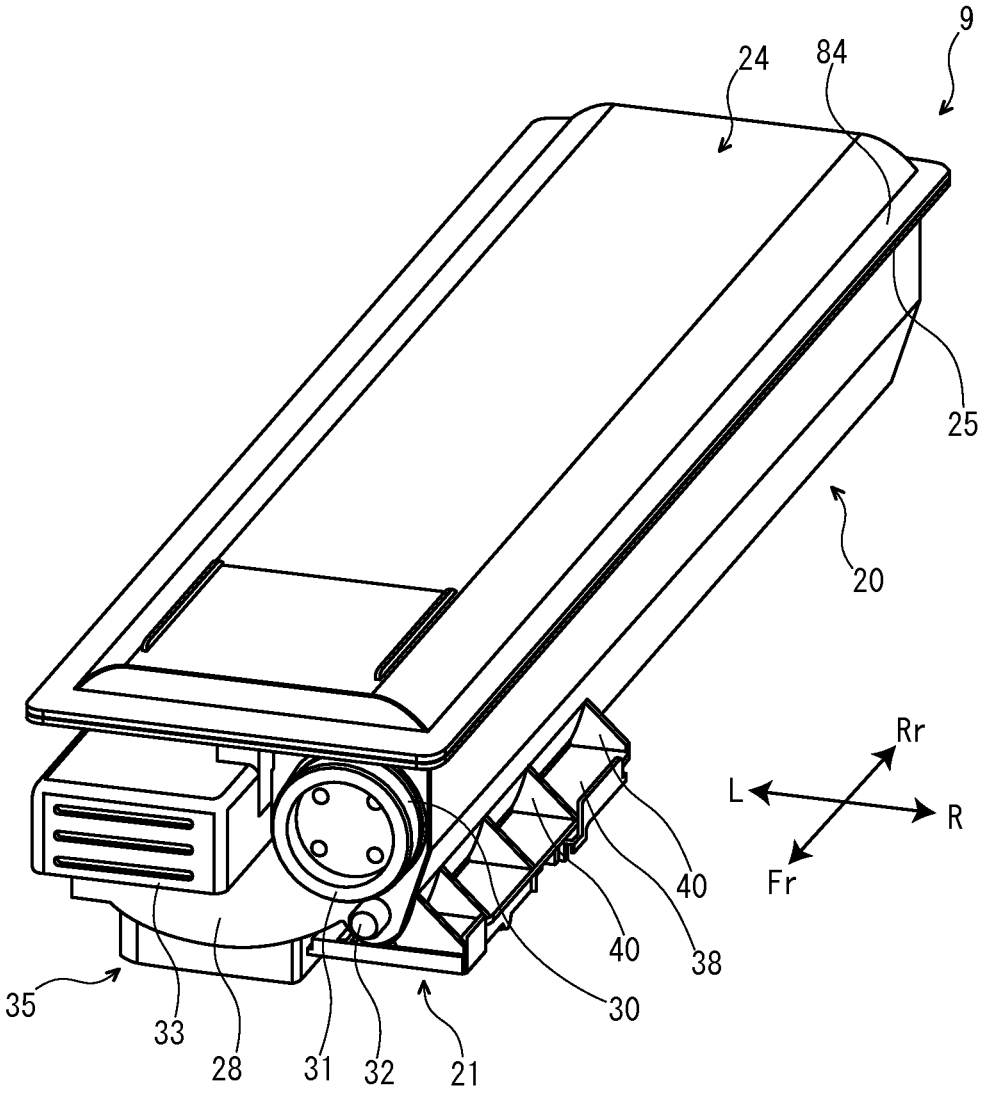
FIG. 5 is a front and top perspective view showing the toner cartridge of the printer according to the embodiment of the present disclosure.

As shown in FIG. 5, at the right portion of the front end wall 28 of the case main body 20, a filling port 30 configured to fill the toner into the case main body 20 is provided. The filling port 30 is closed with a cap 31. At the right and lower portion of the front end wall 28 of the case main body 20, a bearing 32 is provided below the filling port 30. At the left portion of the front end wall 28 of the case main body 20, a handle 33 protruding forward is formed.

Figure 6:
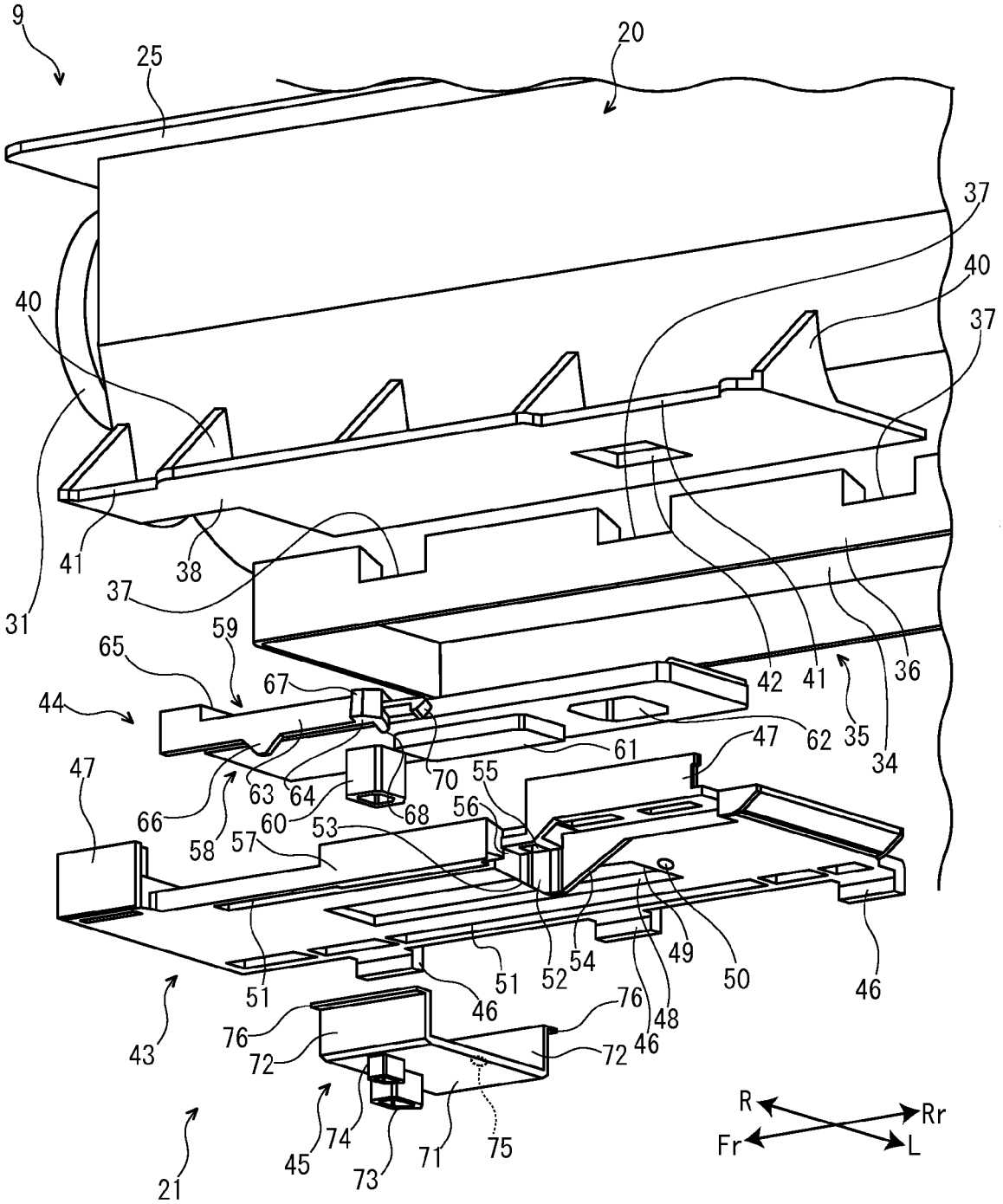
FIG. 6 is an exploded perspective view showing the shutter mechanism of the toner cartridge of the printer according to the embodiment of the present disclosure.

As shown in FIG. 4, at the center of the bottom wall 34 of the case main body 20, a fixed frame 35 is protruded from the front end to the back end of the bottom wall 34. As shown in FIG. 6, at the front end portion of the right side part 36 of the fixed frame 35, a plurality of (for example, three) fixed windows 37 are provided at predetermined intervals in the forward and backward directions.

At the right and front end portion of the bottom wall 34 of the case main body 20, a fixed plate 38 is provided. The fixed plate 38 is formed into a flat plate-like shape elongated in the forward and backward directions, and arranged almost horizontally. The fixed plate 38 is supported by a plurality of supporting plates 40 provided at intervals in the forward and backward directions. At the front and back end portions of the right end part of the fixed plate 38, fixed depressed portions 41 are provided. At the center of the back part of the fixed plate 38, a discharge port 42 having an approximately rectangle shape is provided. The discharge port 42 is communicated with the inside of the case main body 20 so that the toner stored in the inside of the case main body 20 can be discharged through the discharge port 42.

Next, the shutter mechanism 21 will be described. The shutter mechanism 21 has a supporting member 43 arranged below (outside) the case main body 20, a first shutter member 44 arranged below (outside)) the case main body 20 and above (inside) the supporting member 43 and a second shutter member 45 arranged below (outside) the supporting member 43.

Figure 7:
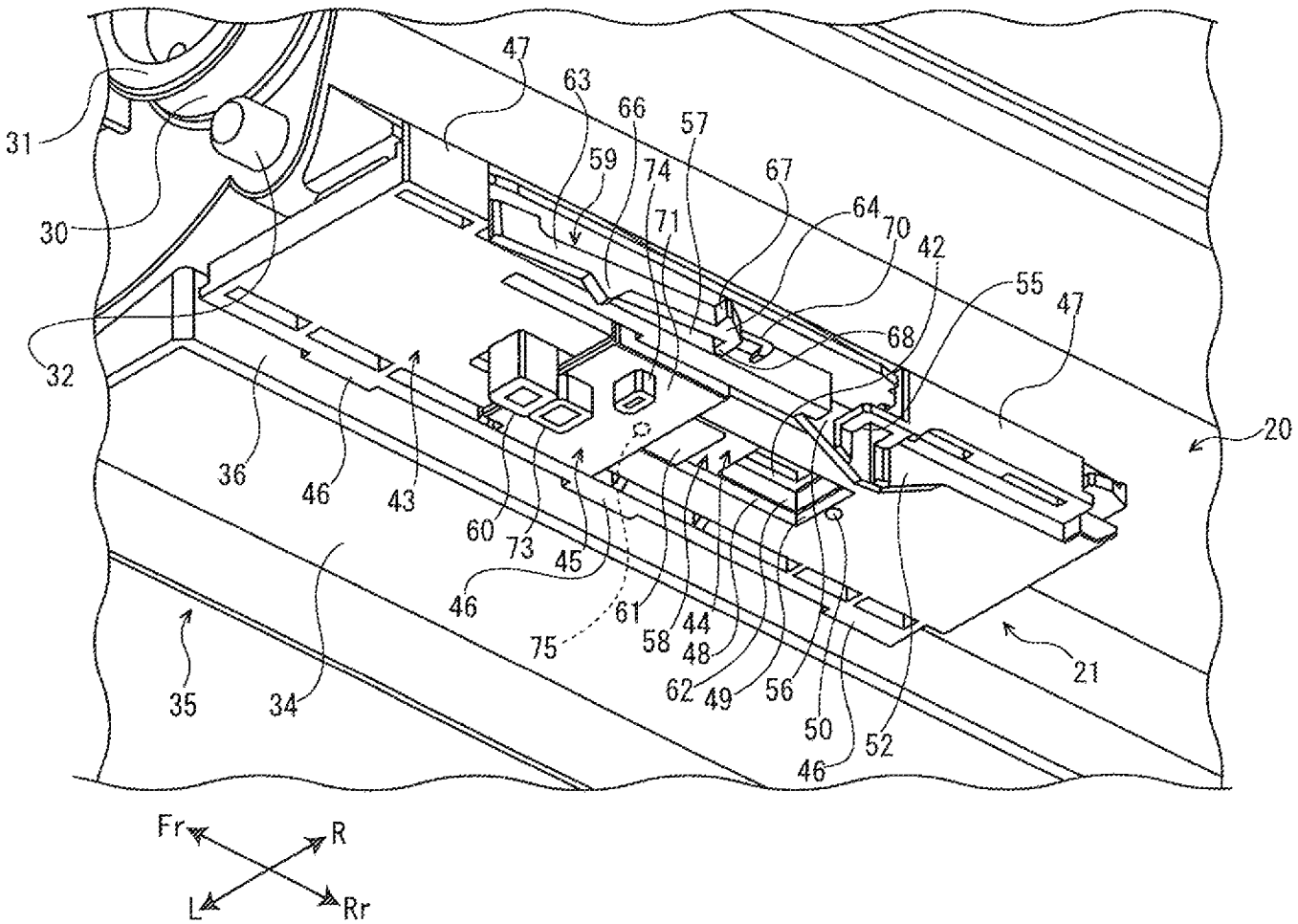
FIG. 7 is a perspective view showing the shutter mechanism of the toner cartridge of the printer according to the embodiment of the present disclosure.

The supporting member 43 is formed into a flat plate-like shape elongated in the forward and backward directions. At the left end of the supporting member 43, a plurality of (for example, three) left fixed pieces 46 protruding leftward at predetermined intervals in the forward and backward directions are provided. At the front and back end portions of the right end of the supporting member 43, right fixed pieces 47 protruding upward are provided. And, each right fixed piece 47 is engaged with each fixed depressed portion 41 provided at the fixed plate 38 of the case main body 20 and also each left fixed piece 46 is engaged with each fixed window 37 provided at the fixed frame 35 of the case main body 20 so that the supporting member 43 is fixed to the case main body 20 with an almost horizontal position (referring to FIG. 7).

As shown in FIG. 6, at the center of the supporting member 43, a communication port 48 having a rectangle shape elongated in the forward and backward directions is provided. The communication port 48 is communicated with the discharge port 42 provided at the fixed plate 38 of the case main body 20. Hereinafter, the discharge port 42 is called as "the discharge port 42 of the case main body 20". On the lower surface (outer surface) of the supporting member 43, a fitting projection 50 (fitting portion) is provided behind the back edge portion 49 (the back side edge portion in the attachment direction) of the communication port 48. The fitting projection 50 has a circular shape in a bottom view. At the left and right of the communication port 48, guiding holes 51 are provided along the forward and backward directions.

On the lower surface (outer surface) of the supporting member 43, a mount portion 52 is protruded downward at the right and back of the right guiding hole 51. At the front of the mount portion 52, a front inclined portion 53 inclined backward and downward is provided. At the back of the mount portion 52, a back inclined portion 54 inclined forward and downward is provided.

The supporting member 43 is provided with a hook hole 55 on the right of the mount portion 52 and an engagement groove 56 in the front of the hook hole 55. In the front of the engagement groove 56, an abutting surface 57 is formed along the forward and backward directions.

The first shutter member 44 has a main body plate 58 and a lock piece 59 formed at the right and front of the main body plate 58.

The main body plate 58 has a rectangle flat plate-like shape elongated in the forward and backward directions and is provided almost horizontally. The main body plate 58 is arranged so as to be sandwiched between the fixed plate 38 of the case main body 20 and the supporting member 43 of the shutter mechanism 21. The main body plate 58 is supported by the supporting member 43 so as to be movable in the forward and backward directions. On the front portion of the lower surface (outer surface) of the main body plate 58, a rectangle tubular first contacting projection 60 is protruded downward. The first contacting projection 60 is inserted into the communication port 48 provided at the supporting member 43 in a movable condition in the forward and backward directions (referring to FIG. 7).

As shown in FIG. 6, on the lower surface of the main body plate 58, a projection piece 61 is protruded downward at the back of the first contacting projection 60. The projection piece 61 has an approximately rectangle flat shape elongated in the forward and backward directions. The projection piece 61 is engaged with the communication port 48 provided at the supporting member 43 in a movable condition in the forward and backward directions (referring to FIG. 7). The first shutter member 44 is provided with a derivation port 62 behind the projection piece 61.

As shown in FIG. 6, the lock piece 59 has an arm 63 extending in the forward and backward directions and a lock portion 64 provided at the back end portion of the arm 63.

The proximal end (front end) of the arm 63 is connected to the front end portion of the main body plate 58 via a connecting portion 65. The arm 63 is configured to be elastically deformable around the proximal end (front end) upward and rightward. At the lower edge of the arm 63, a pressed portion 66 is protruded downward. The front portion of the pressed portion 66 is inclined backward and downward and the back portion of the pressed portion 66 is inclined forward and downward. Therefore, the pressed portion 66 is formed into an approximately isosceles trapezoid shape.

The lock portion 64 is provided with a stopper projection 67 protruding rightward. The lock portion 64 is provided with an abutting projection 68 protruding leftward. The lock portion 64 is provided with a hook 70 protruding backward.

The second shutter member 45 has a length in the forward and backward directions shorter than that of the first shutter member 44. The second shutter member 45 has a lower wall portion 71 arranged almost horizontally and side wall portions 72 bent from the left and right edges of the lower wall portion 71 upward at approximately a right angle. Thus, the second shutter member 45 is formed into an approximately U-shaped form. On the front end portion of the lower surface (outer surface) of the lower wall portion 71, a rectangle tubular second contacting projection 73 is protruded downward. The second contacting projection 73 is positioned behind (at the back side in the attachment direction) the first contacting projection 60 provided at the first shutter member 44 (referring to FIG. 7). On the lower surface (outer surface) of the lower wall portion 71, a rectangle tubular engaged stop projection 74 is protruded downward at the right and back of the second contacting projection 73. On the upper surface (inner surface) of the lower wall portion 71, a fitting depressed portion 75 (fitted portion) is provided. The fitting depressed portion 75 has a circular shape in a plan view.

As shown in FIG. 6, the upper end of each side wall portions 72 is bent outward so as to form a guiding edge portion 76. And, each side wall portion 72 is inserted into each guiding hole 51 of the supporting member 43 and each guiding edge portion 76 comes in contact with the upper surface of the supporting member 43 so that the second shutter member 45 is supported by the supporting member 43 movably in the forward and backward directions.

Next, the conveying screw 22 will be described. As shown in FIG. 4, the conveying screw 22 has a shape elongated in the forward and backward directions and is arranged right above the discharge port 42 of the case main body 20. The conveying screw 22 has a rod-shaped rotating shaft 77 and a spiral fin 78 provided around the circumference face of the rotating shaft 77 concentrically.

The back end of the rotating shaft 77 is penetrated through the back end wall 26 of the case main body 20 and protrudes backward from the back end wall 26. To the protruded portion of the rotating shaft 77, a first following coupling 80 is fixed. The front end of the rotating shaft 77 is supported by the bearing 32 (referring to FIG. 5) provided at the front end wall 28 of the case main body 20. Such a configuration allows the conveying screw 22 to be rotatable relative to the case main body 20.

Next, the agitating paddle 23 will be described. As shown in FIG. 4, the agitating paddle 23 has a shape elongated in the forward and backward directions. The agitating paddle 23 has a supporting frame 81 formed into a plate frame-like shape and a sheet-shaped agitating fin 82 supported by the supporting frame 81. The back end portion of the supporting frame 81 is penetrated through the back end wall 26 of the case main body 20 and protrudes backward from the back end wall 26. To the protruded portion of the supporting frame 81, a second following coupling 83 is fixed. The front end portion of the supporting frame 81 is supported by the front end wall 28 of the case main body 20. Such a configuration allows the agitating paddle 23 to be rotatable relative to the case main body 20.

Next, the covering body 24 will be described. As shown in FIG. 5, the covering body 24 is formed into a rectangular shape elongated in the forward and backward directions. At the outer circumference of the covering body 24, a covering body side flange 84 is provided. The covering body side flange 84 has a shape corresponding to the shape of the main body side flange 25 of the case main body 20. The main body side flange 25 and the covering body side flange 84 are ultrasonic-welded to integrate the case main body 20 and the covering body 24 into one body.

Next, the attachment member 18 (referring to FIG. 2) to which the toner cartridge 9 having the above-mentioned configuration is attached and detached will be described. The attachment member 18 forms a part of the printer main body 2 or developing device 10, for example. As shown in FIG. 2, the attachment member 18 has a support housing 85 extending in the forward and backward directions and a driving unit 86 provided at the back end of the support housing 85. The components will be described in the above-mentioned order.

Figure 8:
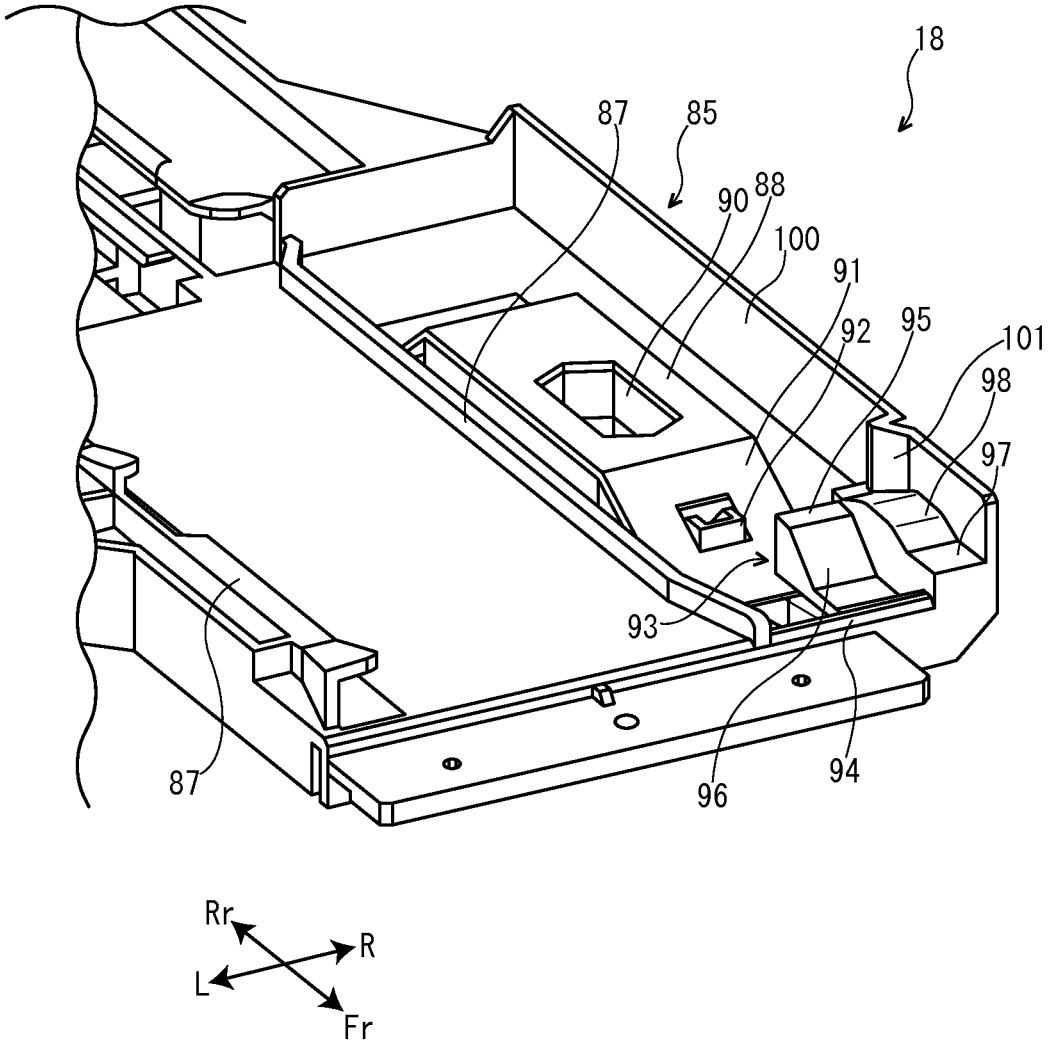
FIG. 8 is a perspective view showing the front portion of the supporting frame of the attachment member of the printer according to the embodiment of the present disclosure.

Firstly, the support housing 85 will be described. The support housing 85 has a flat plate-like shape and is arranged almost horizontally. As shown in FIG. 3, the support housing 85 is configured so as to support the toner cartridge 9, which is attached to the attachment member 18, from below. As shown in FIG. 8, on the front portion of the upper surface of the support housing 85, a pair of left and right guiding rails 87 are provided along the forward and backward directions.

On the front portion of the upper surface (inner surface) of the support housing 85, a pedestal 88 is protruded at the right of the right guiding rail 87. The pedestal 88 has an approximately flat upper surface. At the center of the upper surface of the pedestal 88, a supplying port 90 is provided. The supplying port 90 is communicated with the inside of the developing device 10.

In the front of the pedestal 88, a front inclined surface 91 inclined forward and downward is provided contiguously to the upper surface of the pedestal 88. The front inclined surface 91 is provided with a protruding contacting piece 92. In the back of the pedestal 88, a back inclined portion (not shown) inclined backward and downward is provided contiguously to the upper surface of the pedestal 88.

On the front end portion of the upper surface of the support housing 85, an engaged stop piece 93 is provided at the right of the right guiding rail 87 and in the front of the pedestal 88. The front end of the engaged stop piece 93 is supported by a front edge portion 94 of the support housing 85. The engaged stop piece 93 is elastically deformable downward around the front end. At the back portion of the engaged stop piece 93, a protruded portion 95 protruding upward is provided. The protruded portion 95 is provided with an inclined surface potion 96 inclined backward and upward.

On the front end portion of the upper surface of the supporting member 88, a base portion 97 is protruded at the right of the engaged stop piece 93. On the upper surface of the base portion 97, a bulge portion 98 is provided. On the right end portion of the upper surface of the support housing 85, a guiding frame 100 is provided along the forward and backward directions at the right of the base portion 97. On the front surface of the guiding frame 100, a stopper piece 101 protruding leftward in an approximately V-shaped form is provided. The stopper piece 101 is positioned behind the bulge portion 98.

Next, the driving unit 86 will be described. As shown in FIG. 2, on the right and lower portion of the front surface (inner surface) of the driving unit 86, a first driving coupling 103 is provided. The first driving coupling 103 is configured so as to be coupled to the first following coupling 80 fixed to the conveying screw 22 of the toner cartridge 9 when the toner cartridge 9 is attached to the attachment member 18. The first driving coupling 103 is connected to a driving source (not shown), such as a motor, provided in the driving unit 86. And, when the driving source is rotated under a condition in which the toner cartridge 9 is attached to the attachment member 18, the rotation is transmitted to the conveying screw 22 via the first driving coupling 103 and the first following coupling 80 so that the conveying screw 22 is rotated.

On the center of the front surface (inner surface) of the driving unit 86, a second driving coupling 104 is provided. The second driving coupling 104 is configured so as to be coupled to the second following coupling 83 fixed to the agitating paddle 23 of the toner cartridge 9 when the toner cartridge 9 is attached to the attachment member 18. The second driving coupling 104 is connected to the above-mentioned driving source (not shown). And, when the driving source is rotated under a condition in which the toner cartridge 9 is attached to the attachment member 18, the rotation is transmitted to the agitating paddle 23 via the second driving coupling 104 and the second following coupling 83 so that the agitating paddle 23 is rotated.

At the lower portion of the driving unit 86, a pair of left and right attachment reception portions 105 are provided. When the toner cartridge 9 is attached to the attachment member 18, each attachment projection 27 provided at the back end wall 26 of the toner cartridge 9 is engaged with each attachment reception portion 105.

In the above-mentioned configuration, an operation of the shutter mechanism 21 when the toner cartridge 9 is attached to the attachment member 18 will be described.

Figure 9A:
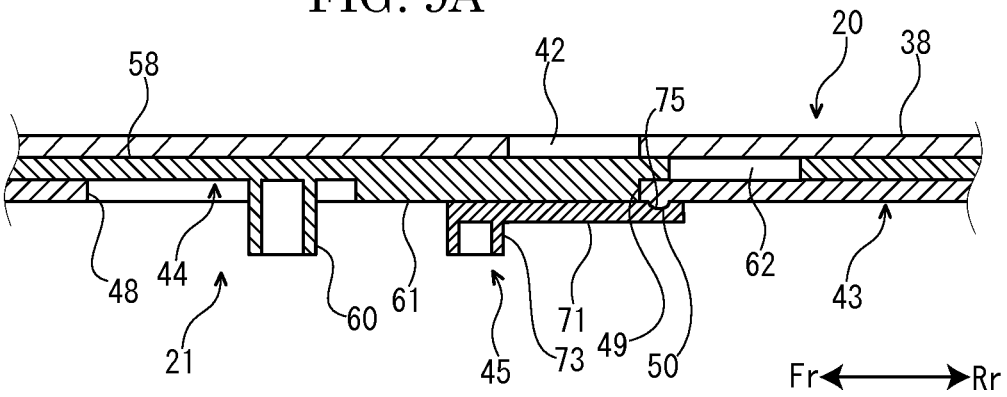
FIG. 9A is a sectional view showing a condition in which the second shutter member is positioned at the covering position and the first shutter member is positioned at the closing position in the toner cartridge of the printer according to the embodiment of the present disclosure.
Figure 10A:
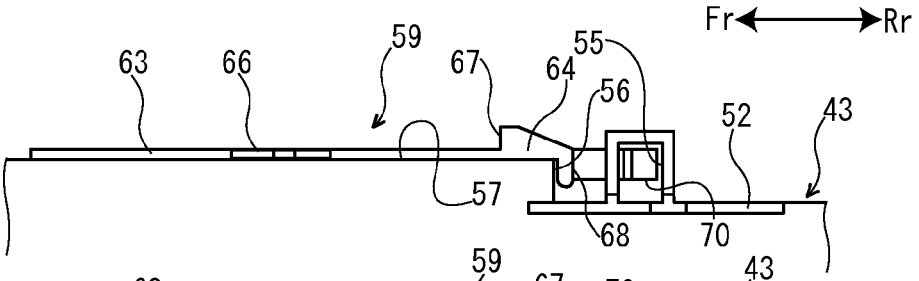
FIG. 10A is a bottom view showing a condition in which a hook is engaged with a hook hole in the printer according to the embodiment of the present disclosure.
Figure 10B:
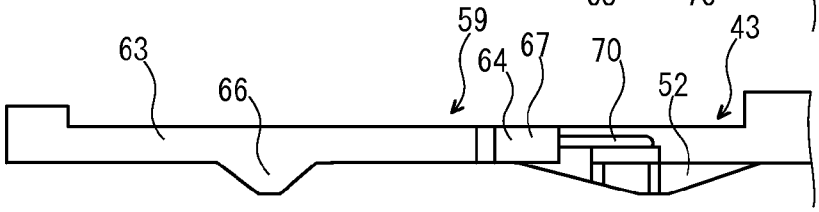
FIG. 10B is a side view showing the same condition as FIG. 10A.

Ina condition in which the toner cartridge 9 is detached from the attachment member 18, as shown in FIG. 9A, the discharge port 42 of the case main body 20 and the communication port 48 of the supporting member 43 are closed with the main body plate 58 of the first shutter member 44. The position of the first shutter member 44 under this situation is defined as a "closing position". Under a condition in which the first shutter member 44 is positioned at the closing position in this way, as shown FIGS. 10A and 10B, the hook 70 of the lock piece 59 of the first shutter member 44 is engaged with the hook hole 55 of the supporting member 43 so that the first shutter member 44 is restricted from being moved relative to the case main body 20 and the supporting member 43 in the forward and backward directions.

In a condition in which the toner cartridge 9 is detached from the attachment member 18, as shown in FIG. 9A, the back edge portion 49 of the communication port 48 provided at the supporting member 43 is covered with the second shutter member 45 from below (outside). The position of the second shutter member 45 under the situation is defined as a "covering position". Under a condition in which the second shutter member 45 is positioned in the covering position, the fitting projection 50 of the supporting member 43 is fitted into the fitting depressed portion 75 of the second shutter member 45 so that the second shutter member 45 is restricted from being moved relative to the case main body 20 and the supporting member 43 in the forward and backward directions.

Figure 9B:
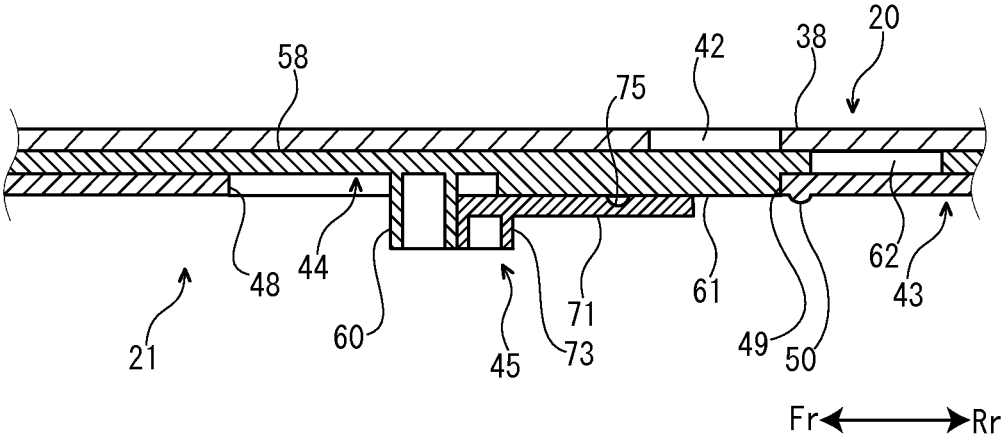
FIG. 9B is a sectional view showing a condition in which the second shutter member is positioned at the exposing position and the first shutter member is positioned at the closing position in the toner cartridge of the printer according to the embodiment of the present disclosure.
Figure 11:
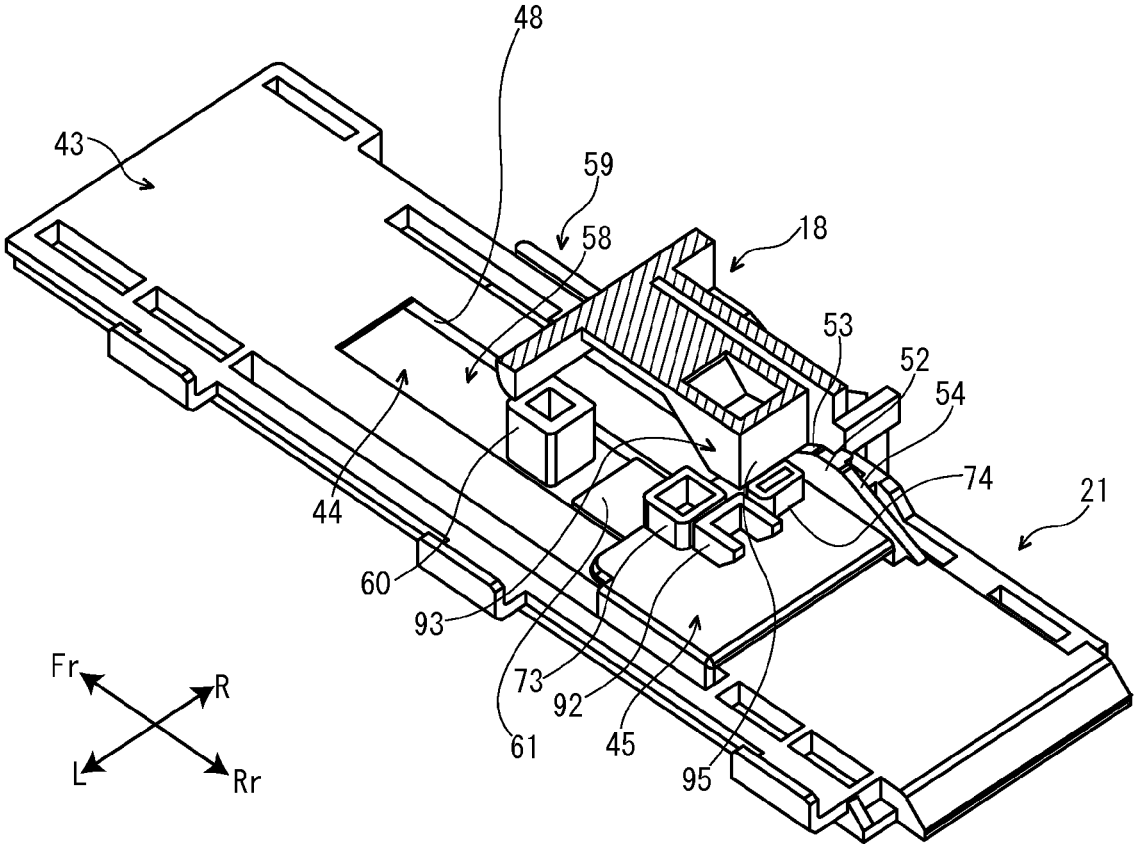
FIG. 11 is a perspective view showing a condition in which the second shutter member is positioned at the covering position and the first shutter member is positioned at the closing position in the printer according to the embodiment of the present disclosure.
Figure 12:
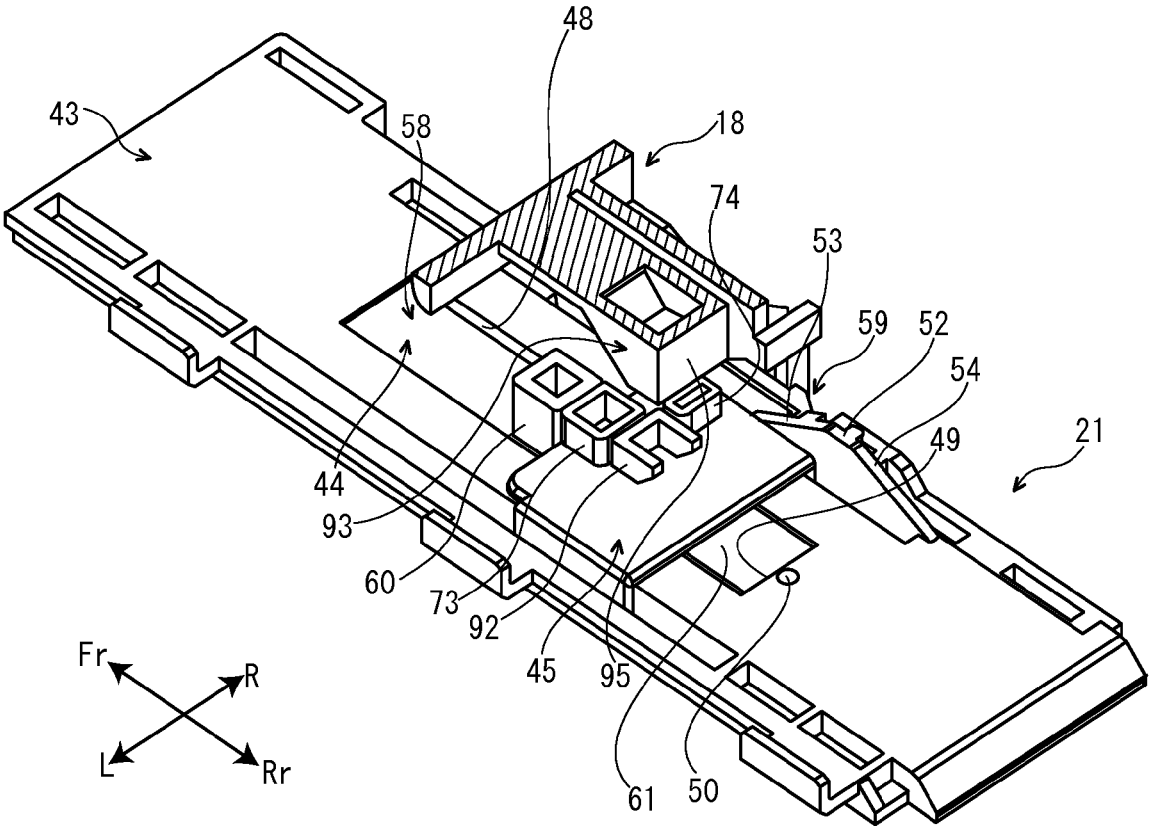
FIG. 12 is a perspective view showing a condition in which the second shutter member is positioned at the exposing position and the first shutter member is positioned at the closing position in the printer according to the embodiment of the present disclosure.

From the above-mentioned condition, as the toner cartridge 9 is pressed backward and attached to the attachment member 18, as shown in FIG. 11, the second contacting projection 73 of the second shutter member 45 comes in contact with the contacting piece 92 of the attachment member 18 and, thus, the second shutter member 45 is restricted from being moved backward. As the toner cartridge 9 is pressed backward further, as shown in FIGS. 9B and 12, the fitting of the fitting projection 50 of the supporting member 43 into the fitting depressed portion 75 of the second shutter member 45 is released and the second shutter member 45 exposes the back edge portion 49 of the communication port 48 of the supporting member 43. The position of the second shutter member 45 in the situation is defined as an "exposing position". When the second shutter member 45 is positioned at the exposing position in this way, simultaneously with this positioning, the second contacting projection 73 of the second shutter member 45 comes in contact with the first contacting projection 60 of the first shutter member 44.

Figure 10C:
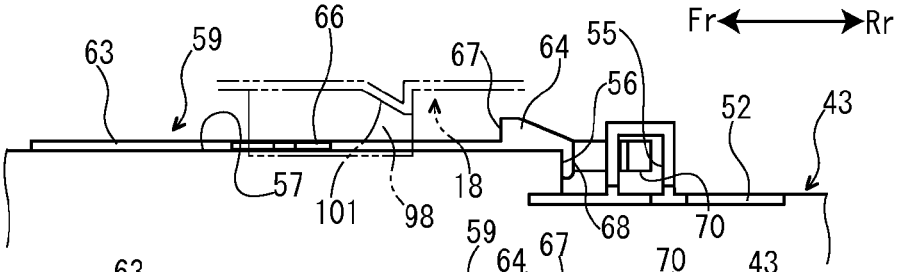
FIG. 10C is a bottom view showing a condition in which an arm of the lock piece is elastically deformed upward and the engagement of the hook with the hook hole is released in the printer according to the embodiment of the present disclosure.
Figure 10D:
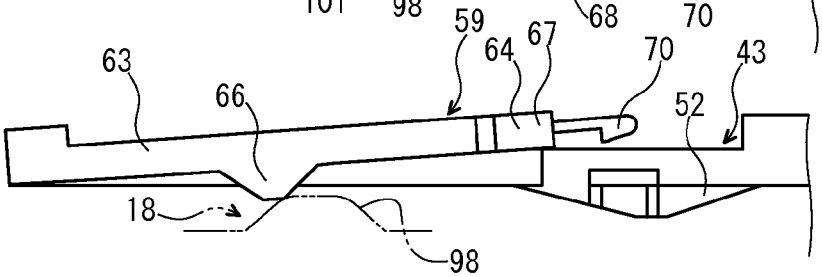
FIG. 10D is a side view showing the same condition as FIG. 10C.
Figure 10E:
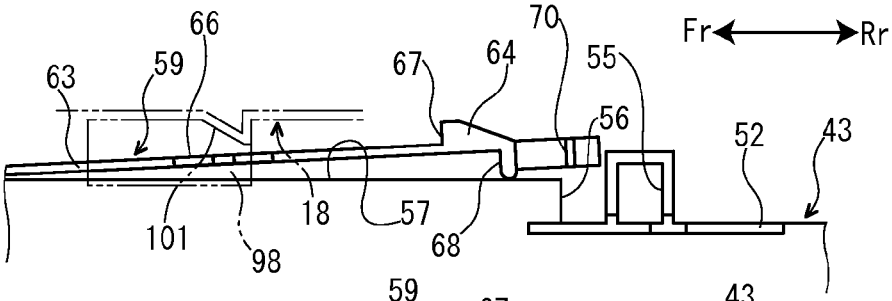
FIG. 10E is a bottom view showing a condition in which the arm of the lock piece is elastically deformed rightward and the engagement of the hook with the hook hole is released in the printer according to the embodiment of the present disclosure.
Figure 10F:
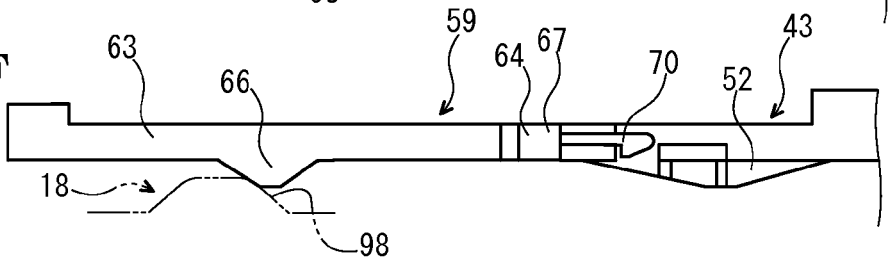
FIG. 10F is a side view showing the same condition as FIG. 10E.

As the toner cartridge 9 is pressed backward further, as shown in FIGS. 10C and 10D, the pressed portion 66 of the lock piece 59 of the first shutter member 44 is pressed against the bulge portion 98 of the attachment member 18, thereby elastically deforming the arm 63 of the lock piece 59 upward. Simultaneously with this deformation, the engagement of the hook 70 of the lock piece 59 of the first shutter member 44 with the hook hole 55 of the supporting member 43 is released. This allows the first shutter member 44 to be moved relative to the case main body 20 and the supporting member 43 in the forward and backward directions. When the pressed portion 66 of the lock piece 59 of the first shutter member 44 passes over the bulge portion 98 of the attachment member 18, as shown in FIGS. 10E and 10F, the arm 63 of the lock piece 59 of the attachment member 18 is elastically deformed downward to be returned to the original position. In addition, the abutting projection 68 of the lock piece 59 comes in contact with the abutting surface 57 of the supporting member 43 and, thus, the arm 63 of the lock piece 59 is elastically deformed rightward.

Figure 9C:
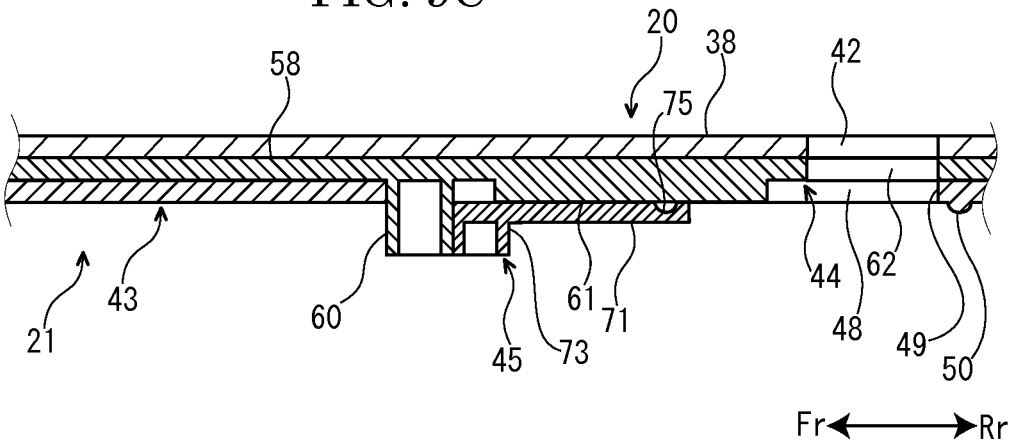
FIG. 9C is a sectional view showing a condition in which the second shutter member is positioned at the exposing position and the first shutter member is positioned at the opening position in the toner cartridge of the printer according to the embodiment of the present disclosure.
Figure 13:
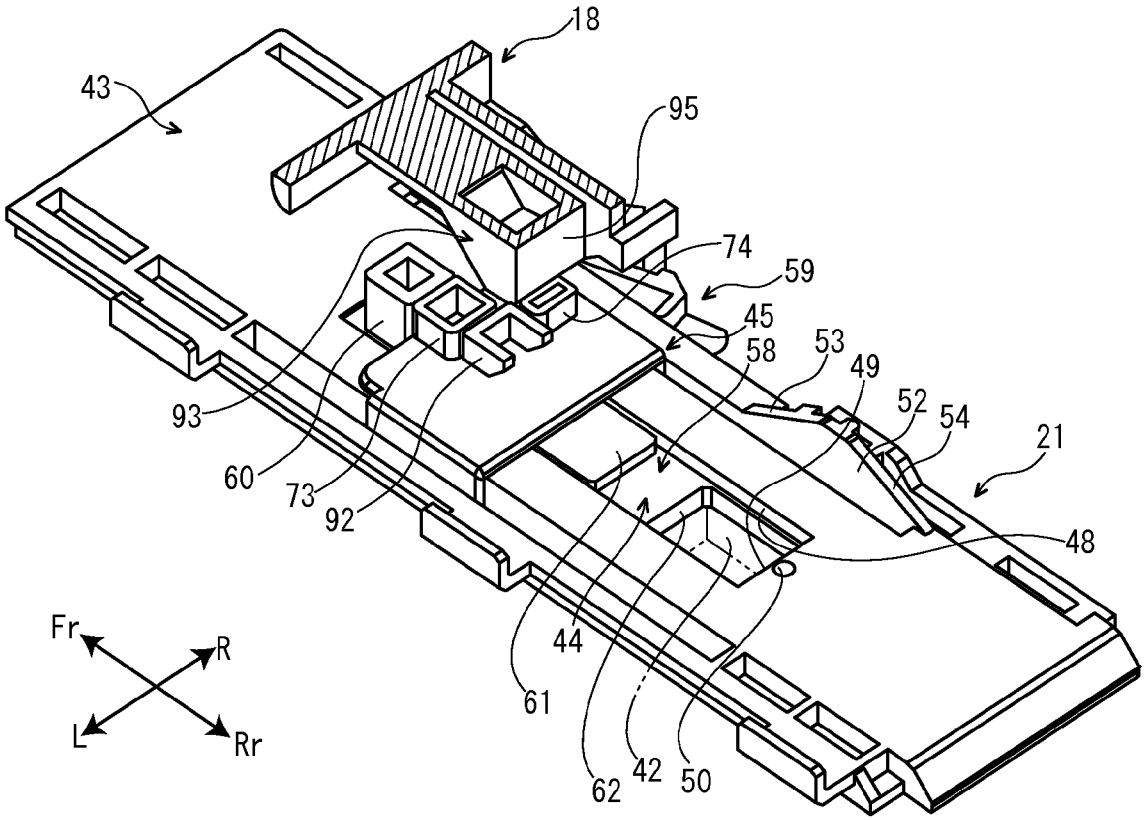
FIG. 13 is a perspective view showing a condition in which the second shutter member is positioned at the exposing position and the first shutter member is positioned at the opening position in the printer according to the embodiment of the present disclosure.

Under the above-mentioned condition, as the toner cartridge 9 is pressed backward further, as shown in FIGS. 9C and 13, the first shutter member 44 opens the discharge port 18 of the case main body 20 and the communication port 48 of the supporting member 43. The position of the first shutter member 44 under this situation is defined as an "opening position".

When the attachment of the toner cartridge 9 to the attachment member 18 is completed in the above-mentioned way, the inside of the case main body 20 is communicated with the outside via the discharge port 42 of the case man body 20, the derivation port 62 of the first shutter member 44 and the communication port 48 of the supporting member 43. This allows the toner stored in the inside of the case main body 20 to be supplied to the development device 10 via the supplying port 90 of the attachment member 18.

Next, in the above-mentioned configuration, an operation of the shutter mechanism 21 when the toner cartridge 9 is detached from the attachment member 18 will be described.

Figure 14A:
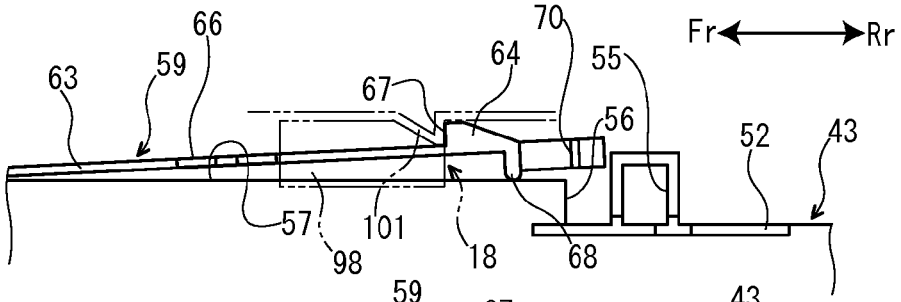
FIG. 14A is a bottom view showing a condition in which a stopper projection is engaged with a stopper piece in the printer according to the embodiment of the present disclosure.
Figure 14B:
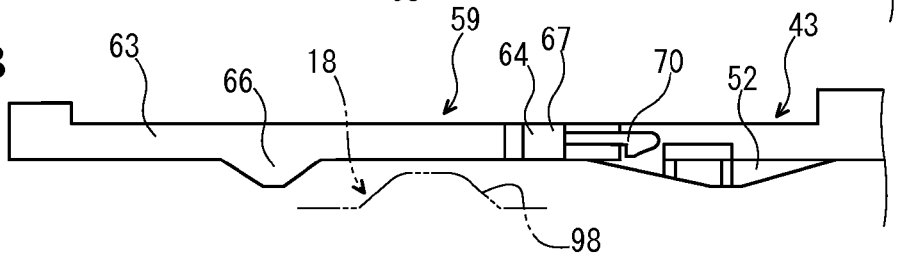
FIG. 14B is a side view showing the same condition as FIG. 14A.

Under a condition in which the toner cartridge 9 is attached to the attachment member 18, as shown in FIGS. 10E and 10F, the abutting projection 68 of the lock piece 59 of the first shutter member 44 comes in contact with the abutting surface 57 of the supporting member 43 and the arm 63 of the lock piece 59 is elastically deformed rightward. Under this condition, as the toner cartridge 9 is pulled out forward and detached from the attachment member 18, as shown in FIGS. 14A and 14B, the stopper projection 67 of the lock piece 59 of the first shutter member 44 is stopped in an engaged state with the stopper piece 101 of the attachment member 18 and, thus, the first shutter member 44 is restricted from being moved forward. Under this condition, as the toner cartridge 9 is pulled out forward further, the position of the first shutter member 44 is changed from the opening position to the closing position (referring to FIG. 12).

Figure 15A:
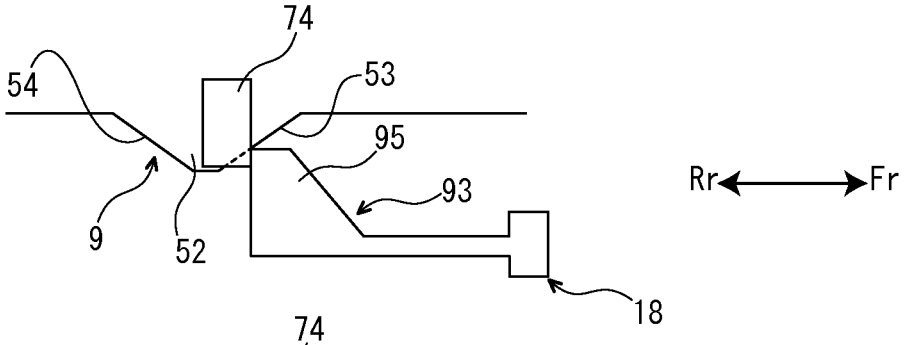
FIGS. 15A, 15B, 15C and 15D are schematic diagrams showing a relationship of the engaged stop projection, a mount portion and the engaged stop piece when the toner cartridge is detached from the attachment member in the printer according to the embodiment of the present disclosure.

As the toner cartridge 9 is pulled out forward further, as shown in FIG. 15A, the engaged stop projection 74 of the second shutter member 45 is stopped in an engaged state with the engaged stop piece 93 of the attachment member 18 and, thus, the second shutter member 45 is restricted from being moved forward. Under this condition, as the toner cartridge 9 is pulled out forward further, the position of the second shutter member 45 is changed from the exposing position to the covering position (referring to FIG. 11).

Figure 15B:
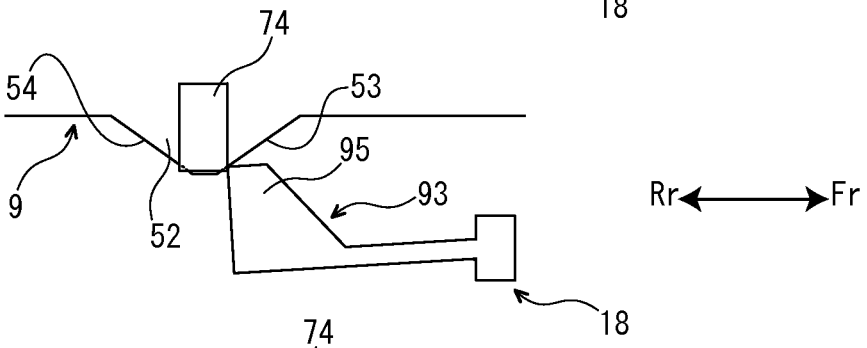

Simultaneously with the engagement of the engaged stop projection 74 of the second shutter member 45 with the engaged stop piece 93 of the attachment member 18 mentioned above, as shown in FIG. 15A, the front inclined portion 53 of the mount portion 52 of the supporting member 43 comes in contact with the engaged stop piece 93. And, as the toner cartridge 9 is pulled out forward further, as shown in FIG. 15B, the front inclined portion 53 of the mount portion 52 presses and elastically deforms the engaged stop piece 93 downward (a side spaced away from the toner cartridge 9).

Figure 15C:
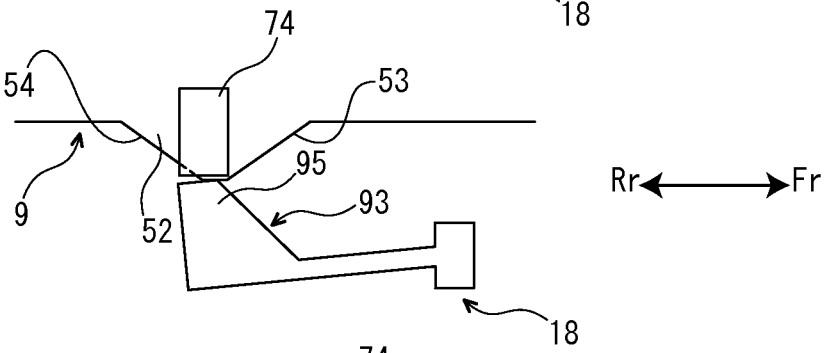
Figure 15D:
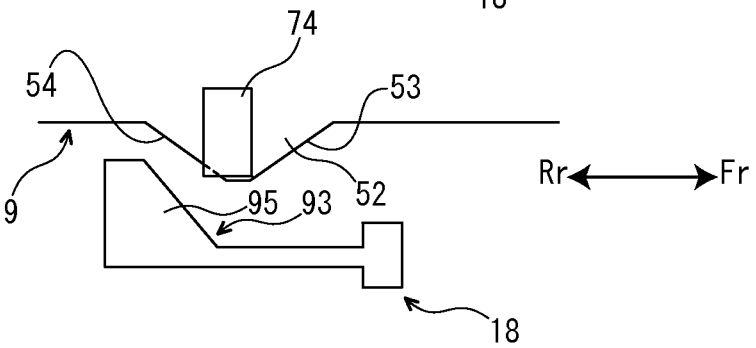

When the position of the second shutter member 45 is changed from the exposing position to the covering position, as shown in FIG. 15C, the engaged stop piece 93 is elastically deformed downward further and the engagement of the engaged stop projection 74 with the engaged stop piece 93 is released. As the toner cartridge 9 is pulled out forward further, as shown in FIG. 15D, the pressing of the mount portion 52 against the engaged stop piece 93 is released. This elastically deforms the engaged stop piece 93 upward to return to the original position.

In the embodiment, as mentioned above, it becomes possible to cover the back edge portion 49 (the back side edge portion in the attachment direction), to which the toner adheres most easily in the communication port 48 of the supporting member 43, with the second shutter member 45 from the outside. Accordingly, when a user changes the toner cartridge 9, it is possible to prevent the user's body, surrounding floor and others from being contaminated with the adhered toner to the communication port 48 of the supporting member 43.

Furthermore, since the second shutter member 45 has the length in the forward and backward directions (attachment direction) shorter than the length in the forward and backward directions (attachment direction) of the first shutter member 44, it becomes possible to reduce the size of the second shutter member 45 compared with a case in which the length of second shutter member 45 in the forward and backward directions is longer than the length of the first shutter member 44 in the forward and backward directions. This also can cause a decrease in cost.

Furthermore, since the first shutter member 44 and the second shutter member 45 are supported by the supporting member 43 movably in the forward and backward directions (attachment direction), it becomes possible to move the first shutter member 44 and the second shutter member 45 along the forward and backward directions by using a simple structure and to change the positions of the first shutter member 44 and the second shutter member 45.

Furthermore, under a condition in which the second shutter member 45 is positioned at the covering position, the fitting projection 50 of the supporting member 43 is fitted into the fitting depressed portion 75 of the second shutter member 45. By applying such a configuration, a carelessly change of the position of the second shutter member 45 from the covering position to the exposing position at the change of the toner cartridge 9 can be prevented surely. Simultaneously with this, it is possible to prevent the user's body, surrounding floor and others from being contaminated with the adhered toner to the communication port 48 of the supporting member 43 more surely.

Furthermore, as the toner cartridge 9 is attached to the attachment member 18, the second contacting projection 73 of the second shutter member 45 comes in contact with the contacting piece 92 of the attachment member 18 and, thus, the position of the second shutter member 45 is changed from the covering position to the exposing position. And, the first contacting projection 60 of the first shutter member 44 comes in contact with the second contacting projection 73 of the second shutter member 45 and, thus, the position of the first shutter member 44 is changed from the closing position to the opening position. By applying such a configuration, simultaneously with an attachment of the toner cartridge 9 to the attachment member 18, the position of the second shutter member 45 can be easily changed from the covering position to the exposing position and also the position of the first shutter member 44 can be easily changed from the closing position to the opening position.

As the toner cartridge 9 is detached from the attachment member 18, the engaged stop projection 74 of the second shutter member 45 is stopped in an engaged state with the engaged stop piece 93 of the attachment member 18 and, thus, the position of the second shutter member 45 is changed from the exposing position to the covering position. And, the mount portion 52 of the supporting member 43 presses and deforms the engaged stop piece 93 of the attachment member 18 downward (to a side spaced away from the toner cartridge 9) so as to release the engagement of the engaged stop projection 74 with the engaged stop piece 93. By applying such a configuration, simultaneously with the detachment of the toner cartridge 9 from the attachment member 18, the position of the second shutter member 45 can be easily changed from the exposing position to the covering position.

When the toner cartridge 9 is attached to the attachment member 18, the position of the first shutter member 44 has been changed from the closing position to the opening position after changing the position of the second shutter member 45 from the covering position to the exposing position. On the other hand, when the toner cartridge 9 is detached from the attachment member 18, the position of the second shutter member 45 has been changed from the exposing position to the covering position after changing the position of the first shutter member 44 from the opening position to the closing position. By applying such a configuration, it is possible to prevent the user's body, surrounding floor and others from being contaminated with the adhered toner to the communication port 48 of the supporting member 43 more surely.

In the embodiment, a case in which a linearly movable slide type shutter is used as the first shutter member 44 and the second shutter member 45 is described. However, in another different embodiment, a rotation type shutter may be used as the first shutter member 44 and the second shutter member 45.

In the embodiment, although a case in which the first shutter member 44 and the second shutter member 45 are supported by the supporting member 43, in another different embodiment, either one of or both of the first shutter member 44 and the second shutter member 45 may be supported by the container main body 20.

In the embodiment, although the configuration of the present disclosure is applied to the toner cartridge 9, in another different embodiment, the configuration of the present disclosure may be applied to a toner case (what is called "intermediate hopper") arranged between the toner cartridge 9 and the development device 10.

Although the embodiment was described in a case where configurations of the disclosure are applied into the printer 1, in another different embodiment, the configurations of the disclosure may be applied into another image forming apparatus, such as a copying machine, a facsimile, multifunctional peripheral or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an attachment member; and a toner case attachable and detachable to/from the attachment member along an attachment direction, wherein the toner case includes:

a case main body having a discharge port configured to discharge a toner; and a shutter mechanism configured to open and close the discharge port, wherein the shutter mechanism has:

a supporting member arranged outside the case main body and having a communication port communicating with the discharge port;

a first shutter member positioned at a closing position configured to close the discharge port and the communication port in a condition in which the toner case is detached from the attachment member, and at an opening position configured to open the discharge port and the communication port in a condition in which the toner case is attached to the attachment member; and a second shutter member positioned at a covering position configured to cover the back side edge portion of the communication port in the attachment direction from the outside in a condition in which the toner case is detached from the attachment member, and at an exposing position configured to expose the back side edge portion of the communication port in the attachment direction in a condition in which the toner case is attached to the attachment member.

2. The image forming apparatus according to claim 1, wherein the second shutter member has a length in the attachment direction shorter than a length in the attachment direction of the first shutter member.

3. The image forming apparatus according to claim 1, wherein the first shutter member is arranged outside the case main body and inside the supporting member and supported by the supporting member so as to be movable along the attachment direction, and the second shutter member is arranged outside the supporting member and supported by the supporting member so as to be movable along the attachment direction.

4. The image forming apparatus according to claim 3, wherein a fitting portion is provided on the outer surface of the supporting member, and a fitted portion, into which the fitting portion is fit in a condition in which the second shutter member is positioned at the covering position, is provided on the inner surface of the second shutter member.

5. The image forming apparatus according to claim 1, wherein a first contacting projection is provided on the outer surface of the first shutter member, a second contacting projection is provided on the outer surface of the second shutter member, at the back side of the first contacting projection in the attachment direction, a contacting piece is provided on the inner surface of the attachment member, and as the toner case is attached to the attachment member, the second contacting projection comes in contact with the contacting piece to change the position of the second shutter member from the covering position to the exposing position, and the first contacting projection comes in contact with the second contacting projection to change the position of the first shutter member from the closing position to the opening position.

6. The image forming apparatus according to claim 1, wherein an engaged stop piece deformable on a side spaced away from the toner case is provided on the inner surface of the attachment member, a mount portion capable of pressing the engaged stop piece is provided on the outer surface of the supporting member, an engaged stop projection stopped in an engaged state with the engaged stop piece is provided on the outer surface of the second shutter member, and as the toner case is detached from the attachment member, the engaged stop projection is stopped in an engaged state with the engaged stop piece to change the position of the second shutter member from the exposing position to the covering position, and the mount portion presses and thus deforms the engaged stop piece on the side spaced away from the toner case so as to release the engagement of the engaged stop projection with the engaged stop piece.

7. The image forming apparatus according to claim 1, wherein the second shutter member has a lower wall portion, and side wall portions bent upward from the both sides of the lower wall portion.

8. The image forming apparatus according to claim 7, wherein the supporting member has guiding holes along the attachment direction, the side wall portions have guiding edge portions bent outward, and the guiding edge portions come in contact with the upper face of the supporting member in a condition in which the side wall portions are inserted into the guiding holes.

9. A toner case provided at an image forming apparatus with an attachment member and attachable and detachable to/from the attachment member along an attachment direction comprising:

a case main body having a discharge port configured to discharge a toner; and a shutter mechanism configured to open and close the discharge port, wherein the shutter mechanism has:

a supporting member arranged outside the case main body and having a communication port communicating with the discharge port;

a first shutter member positioned at a closing position configured to close the discharge port and the communication port in a condition in which the toner case is detached from the attachment member, and at an opening position configured to open the discharge port and the communication port in a condition in which the toner case is attached to the attachment member; and a second shutter member positioned at a covering position configured to cover the back side edge portion of the communication port in the attachment direction from the outside in a condition in which the toner case is detached from the attachment member, and at an exposing position configured to expose the back side edge portion of the communication port in the attachment direction in a condition in which the toner case is attached to the attachment member.

10. The toner case according to claim 9, wherein the second shutter member has a length in the attachment direction shorter than a length in the attachment direction of the first shutter member.

11. The toner case according to claim 9, wherein the first shutter member is arranged outside the case main body and inside the supporting member and supported by the supporting member so as to be movable along the attachment direction, and the second shutter member is arranged outside the supporting member and supported by the supporting member so as to be movable along the attachment direction.

12. The toner case according to claim 11, wherein a fitting portion is provided on the outer surface of the supporting member, and a fitted portion, into which the fitting portion is fit in a condition in which the second shutter member is positioned at the covering position, is provided on the inner surface of the second shutter member.

13. The toner case according to claim 9, wherein a first contacting projection is provided on the outer surface of the first shutter member, a second contacting projection is provided on the outer surface of the second shutter member, at the back side of the first contacting projection in the attachment direction, a contacting piece is provided on the inner surface of the attachment member, and as the toner case is attached to the attachment member, the second contacting projection comes in contact with the contacting piece to change the position of the second shutter member from the covering position to the exposing position, and the first contacting projection comes in contact with the second contacting projection to change the position of the first shutter member from the closing position to the opening position.

14. The toner case according to claim 9, wherein an engaged stop piece deformable on a side spaced away from the toner case is provided on the inner surface of the attachment member, a mount portion capable of pressing the engaged stop piece is provided on the outer surface of the supporting member, an engaged stop projection stopped in an engaged state with the engaged stop piece is provided on the outer surface of the second shutter member, and as the toner case is detached from the attachment member, the engaged stop projection is stopped in an engaged state with the engaged stop piece to change the position of the second shutter member from the exposing position to the covering position, and the mount portion presses and thus deforms the engaged stop piece on the side spaced away from the toner case so as to release the engagement of the engaged stop projection with the engaged stop piece.

15. The toner case according to claim 9, wherein the second shutter member has a lower wall portion, and side wall portions bent upward from the both sides of the lower wall portion.

16. The toner case according to claim 15, wherein the supporting member has guiding holes along the attachment direction, the side wall portions have guiding edge portions bent outward, and the guiding edge portions come in contact with the upper face of the supporting member in a condition in which the side wall portions are inserted into the guiding holes.

* * * * *